US010455959B2

(12) United States Patent
Coon et al.

(10) Patent No.: US 10,455,959 B2
(45) Date of Patent: Oct. 29, 2019

(54) PORTABLE BEVERAGE CONTAINER WITH A ROBUST AND EASILY CLEANABLE SEAL MECHANISM

(71) Applicant: IGNITE USA, LLC, Chicago, IL (US)

(72) Inventors: Robert Coon, Chicago, IL (US); Jeff Chiu, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 24 days.

(21) Appl. No.: 15/402,913

(22) Filed: Jan. 10, 2017

(65) Prior Publication Data

US 2018/0192800 A1 Jul. 12, 2018

(51) Int. Cl.

| | |
|---|---|
| ***A47G 19/22*** | (2006.01) |
| ***B65D 47/06*** | (2006.01) |
| ***B65D 47/08*** | (2006.01) |
| ***B65D 25/46*** | (2006.01) |

(52) U.S. Cl.

CPC ..... *A47G 19/2266* (2013.01); *A47G 19/2272* (2013.01); *B65D 25/46* (2013.01); *B65D 47/065* (2013.01); *B65D 47/066* (2013.01); *B65D 47/0871* (2013.01)

(58) Field of Classification Search

CPC ..... A47G 19/2266; A47G 19/2272; B65D 47/065; B65D 47/066; B65D 47/0871; B65D 25/46

See application file for complete search history.

(56) References Cited

U.S. PATENT DOCUMENTS

| | | | | |
|---|---|---|---|---|
| 5,553,726 | A * | 9/1996 | Park | A61J 11/0005 215/11.1 |
| 6,523,711 | B1 * | 2/2003 | Hughes | A47G 19/2266 215/308 |
| 6,568,557 | B2 * | 5/2003 | Fusco | A47G 19/2272 215/11.5 |
| 8,602,238 | B2 | 12/2013 | El-Saden et al. | |
| 8,727,176 | B2 | 5/2014 | El-Saden et al. | |
| 8,844,762 | B2 | 9/2014 | Chiou et al. | |
| 8,863,979 | B2 | 10/2014 | El-Saden et al. | |
| 9,162,802 | B2 | 10/2015 | El-Saden et al. | |
| D756,702 | S | 5/2016 | Joseph et al. | |
| 9,844,285 | B2 * | 12/2017 | Hoskins | A47G 19/2266 |
| 2005/0133519 | A1 * | 6/2005 | McDonough | A47G 19/2266 220/705 |
| 2014/0048511 | A1 | 2/2014 | El-Saden et al. | |
| 2015/0060448 | A1 | 3/2015 | Coon et al. | |

* cited by examiner

*Primary Examiner* — Nicholas J. Weiss
(74) *Attorney, Agent, or Firm* — Marshall, Gerstein & Borun LLP

(57) ABSTRACT

A portable beverage container includes a container body defining an interior adapted to store a liquid, and a lid assembly that includes a lid housing removably coupled to the container body and a spout coupled to the lid housing and movable between a stowed configuration and a dispensing configuration, the spout defining a fluid passageway in selective fluid communication with the interior of the container body. The lid assembly also includes a seal housing carrying a sealing element, the seal housing movably coupled to the lid housing between an in-use position, wherein the seal housing engages the spout such that the sealing element controls fluid flow through the fluid passageway of the spout, and a cleaning position, wherein the seal housing is spaced from the spout to permit cleaning of the sealing element.

16 Claims, 11 Drawing Sheets

PORTABLE BEVERAGE CONTAINER WITH A ROBUST AND EASILY CLEANABLE SEAL MECHANISM

FIELD OF THE DISCLOSURE

The present disclosure is directed to portable beverage containers and, more particularly, to a portable beverage container that has a robust and easily cleanable seal mechanism.

BACKGROUND

Portable beverage containers, such as tumblers, mugs, and the like, are commonly used by consumers who want to drink water, coffee, tea, or other liquids when walking, driving, or otherwise traveling between two different places. Portable beverage containers typically include a container body and a lid that is removably coupled to the container body and includes a fluid aperture. When the lid is removed, the container body can be emptied or filled with the desired liquid (e.g., water) by the consumer. Conversely, when the lid is coupled to the container body, the consumer can drink the liquid by tipping the container in a manner that allows the beverage to pass through the fluid aperture.

To prevent consumers from spilling the liquid contents of portable beverage containers, beverage containers with spouts were developed. Spouts are generally movable, relative to the container body, between a closed, stowed configuration and an open, dispensing configuration. When the spout is in the dispensing configuration, the liquid contents can flow out of the container through the spout, thereby permitting a user to drink from the container. When drinking is no longer desired, the spout can be moved to the stowed configuration, whereby the liquid contents are prevented from flowing out of the container.

In some cases, portable beverage containers with spouts can also be equipped with a straw that facilitates consumption of the liquid contents of the beverage container when the spout is in the dispensing configuration. Portable beverage containers may also include a sealing element (e.g., a one-way valve) that allows the consumer to drink the liquid contents from the spout (and the straw, when utilized) but prevents accidental spillage or leakage from the beverage container. One known portable beverage container relies on an interference fit to retain the sealing element in place, while another known portable beverage container is equipped with a straw having a component that utilizes a snap fit to locate the sealing element in place.

SUMMARY

In accordance with one exemplary aspect of the present disclosure, a lid assembly is provided for use with a portable beverage container. The lid assembly includes a lid housing, a spout coupled to the lid housing, the spout defining a fluid passageway, and a seal housing carrying a sealing element. The spout is movable between a stowed configuration and a dispensing configuration. The seal housing is movably coupled to the lid housing between an in-use position, wherein the seal housing engages the spout such that the sealing element controls fluid flow through the fluid passageway of the spout, and a cleaning position, wherein the seal housing is spaced from the spout to permit cleaning of the sealing element.

In accordance with another exemplary aspect of the present disclosure, a portable beverage container is provided. The portable beverage container includes a container body defining an interior adapted to store a liquid, and a lid assembly. The lid assembly includes a lid housing removably coupled to the container body and a spout coupled to the lid housing and movable between a stowed configuration and a dispensing configuration, the spout defining a fluid passageway in selective fluid communication with the interior of the container body. The lid assembly also includes a seal housing carrying a sealing element, the seal housing movably coupled to the lid housing between an in-use position, wherein the seal housing engages the spout such that the sealing element controls fluid flow through the fluid passageway of the spout, and a cleaning position, wherein the seal housing is spaced from the spout to permit cleaning of the sealing element.

In accordance with another exemplary aspect of the present disclosure, a lid assembly is provided for use with a portable beverage container. The lid assembly includes a lid housing, a spout coupled to the lid housing, the spout defining a fluid passageway, and a seal mechanism. The seal mechanism includes a seal housing carrying a sealing element, and a support arm. The seal housing is movably coupled to the lid housing, via the support arm, between an in-use position, wherein the seal housing engages the spout such that the sealing element permits fluid flow through the fluid passageway in a single direction when negative pressure is applied to the sealing element via the spout, and a cleaning position, wherein the seal housing is spaced from the spout to permit cleaning of the sealing element.

BRIEF DESCRIPTION OF THE DRAWINGS

The disclosure may be best understood by reference to the following description taken in conjunction with the accompanying drawings, in which like reference numerals identify like elements in the several FIGS., in which.

DETAILED DESCRIPTION

Figure 1:
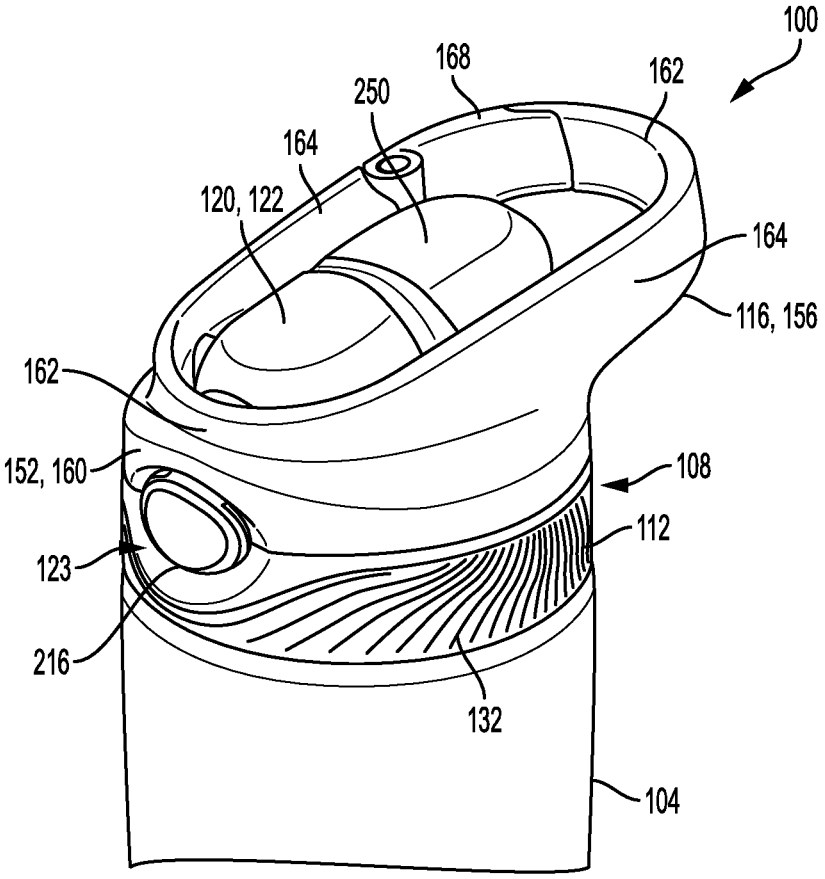
FIG. 1 is a perspective view of one example of a portable beverage container constructed in accordance with the principles of the present disclosure, showing a spout of the portable beverage container in a closed, stowed configuration that prevents liquid discharge from the portable beverage container.
Figure 2:
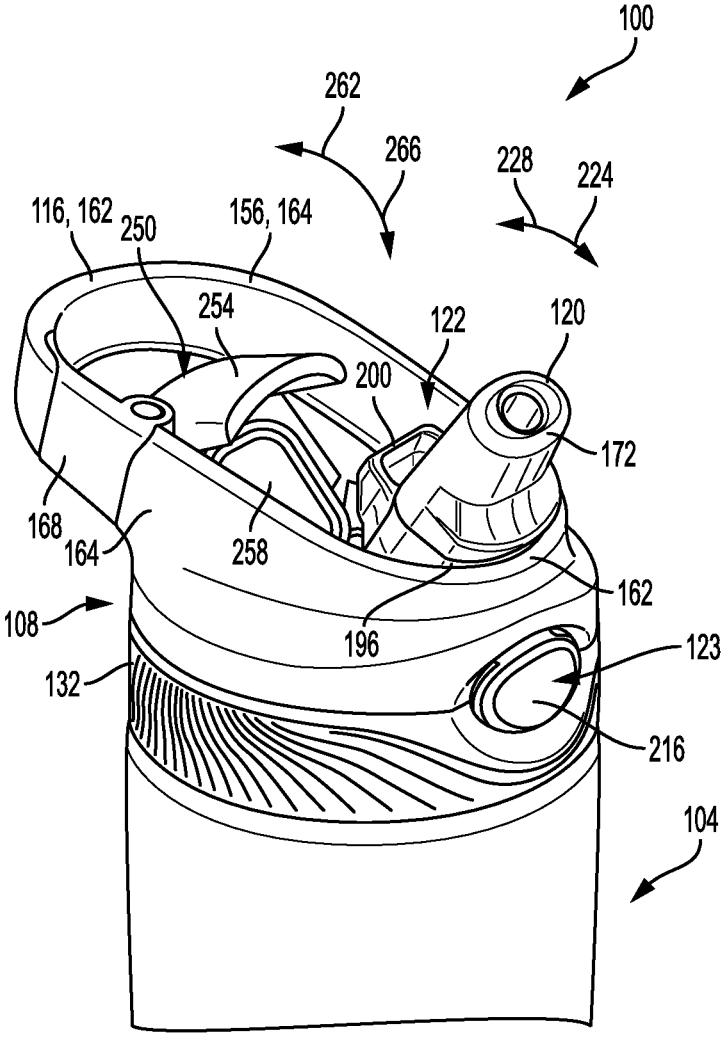
FIG. 2 is similar to FIG. 1, but shows the spout of the portable beverage container in an open, dispensing configuration that allows a user of the portable beverage container to consume liquid contents of the container.

FIGS. 1-12 depict one example of a portable and reusable beverage container 100 constructed in accordance with the principles of the present disclosure. The beverage container 100, which in this example is a bottle but may instead take the form of a mug, a tumbler, or the like, generally includes a container body 104 (only partially shown) and a lid assembly 108 removably coupled to the container body 104. The container body 104 has an interior volume or reservoir that is configured to store or contain a liquid, which may be hot or cold, for example, water, juice, soda, milk, tea, coffee, or any other beverage, for consumption by a user of the container 100. The lid assembly 108, which can be removably coupled to the container body 104 in any known manner (e.g., via threaded engagement), is generally movable between a closed or stowed position, as shown in FIG. 1, whereby the liquid is sealed within the container body 104, and an open or dispensing position, as shown in FIG. 2, whereby the user of the container 100 can consume (e.g., drink) the liquid stored in the container body 104.

As best illustrated in FIGS. 1-4, the lid assembly 108 includes, in relevant part, a lid housing 112, a handle 116, a spout 120, a collar 122 coupled to the spout 120, and an actuator assembly 123 coupled to the lid housing 112. The handle 116 is coupled to the lid housing 112 and, when the lid assembly 108 is coupled to the container body 104, the handle 116 allows the user of the beverage container 100 to carry or otherwise transport the beverage container 100. The lid housing 112 and the handle 116 together at least partially house the spout 120 and the spout collar 122, which are generally movable from a closed, stowed configuration, shown in FIGS. 1 and 4, to an open, dispensing configuration, shown in FIGS. 2 and 3, responsive to manipulation of the actuator assembly 123. The lid assembly 108 illustrated in FIGS. 1-4 does not include a straw (i.e., it is strawless) that fluidly couples the interior of the container body 104 and the spout 120, though it is possible that the lid assembly 108 may include a straw in other examples.

Figure 3:
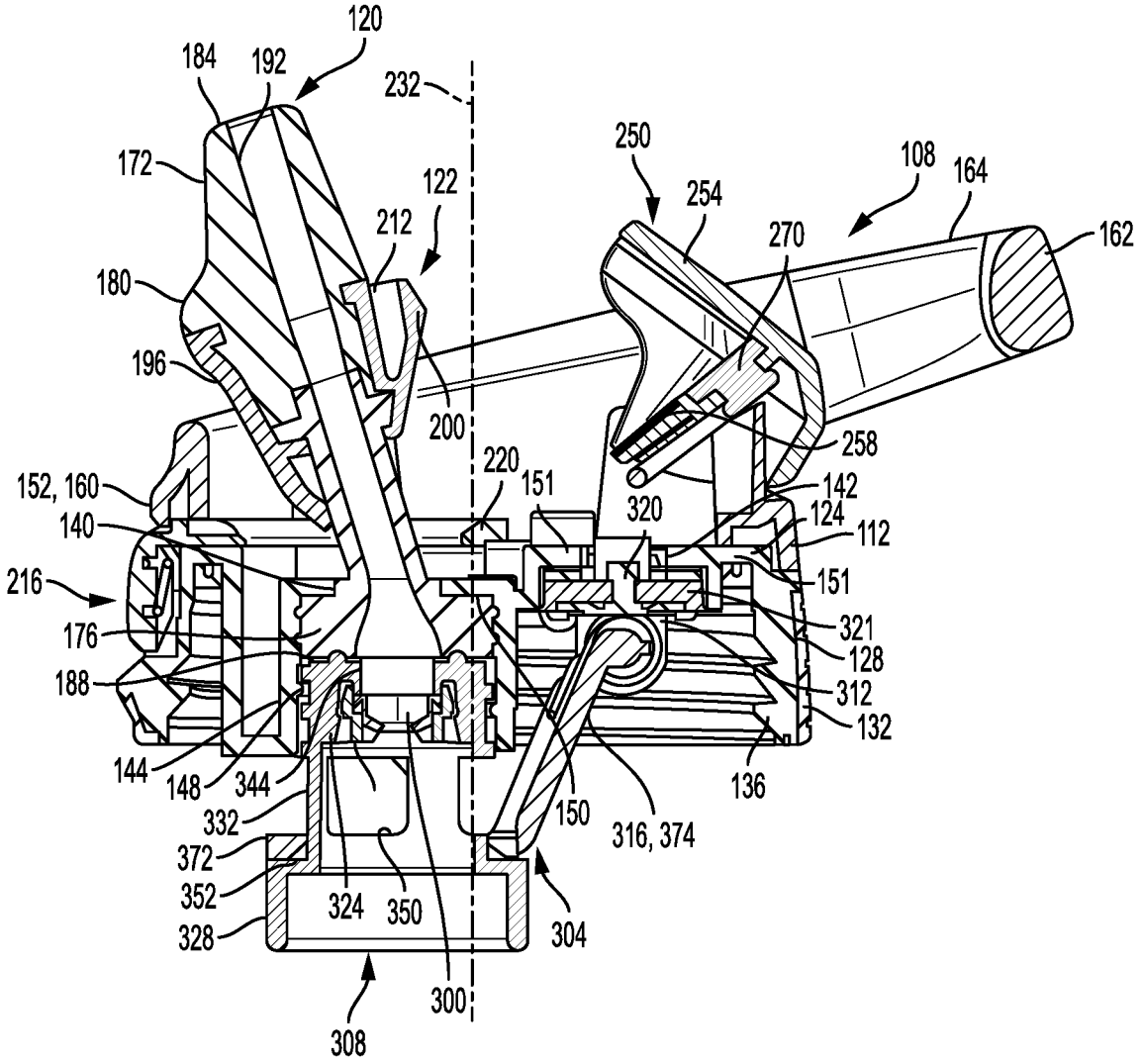
FIG. 3 is a cross-sectional view of a lid assembly of the portable beverage container of FIG. 2, showing a seal mechanism of the lid assembly in an in-use position that allows the user to consume the liquid contents of the container but prevents accidental spillage or leakage from the container.
Figure 4:
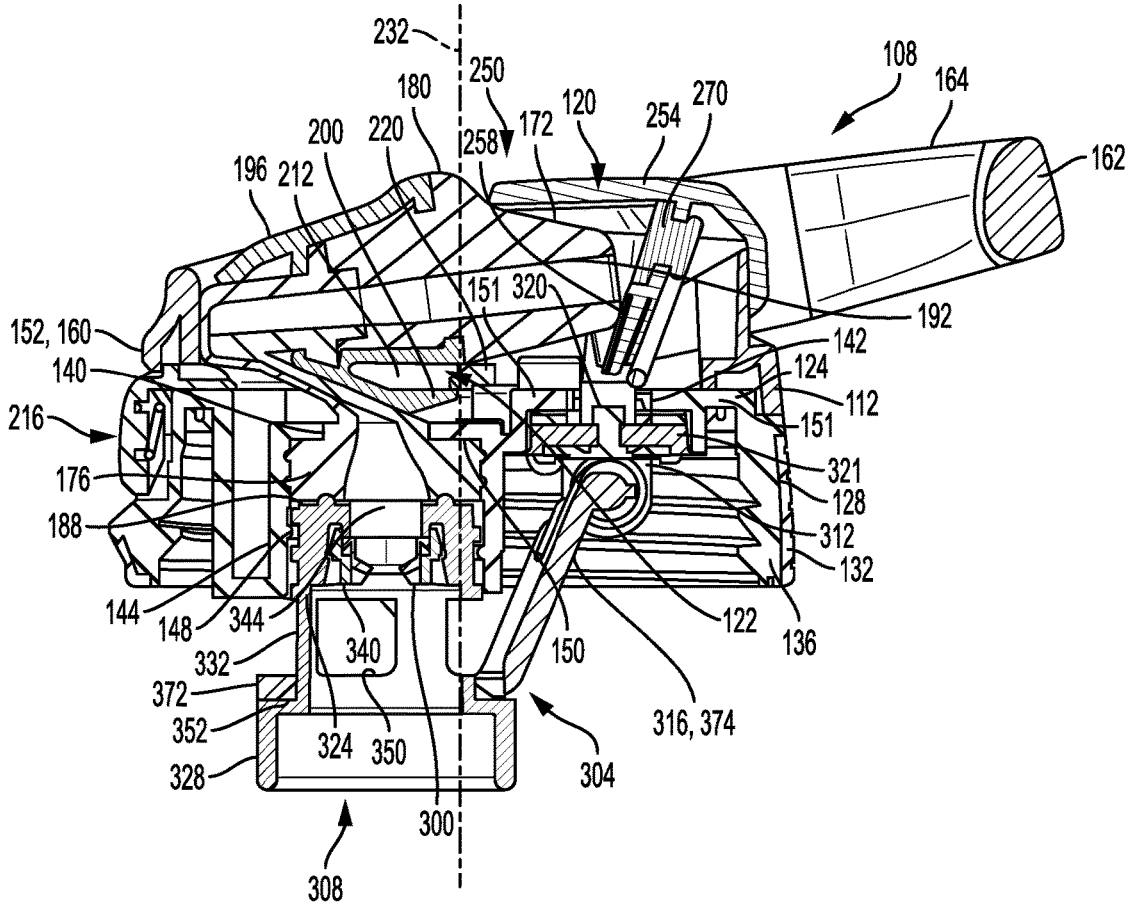
FIG. 4 is another cross-sectional view of the lid assembly, but showing the spout in the closed, stowed configuration.

With reference to FIGS. 3 and 4, the lid housing 112 in this example has a generally annular or circular shape defined by a base 124 and a circumferential wall 128 that extends outwardly from the base 124. As shown, the circumferential wall 128 has an outer or exterior surface 132 that is at least partially overmolded with a material, e.g., a thermoplastic elastomer, suitable for facilitating gripping of the lid housing 112. The circumferential wall 132 also has an inner surface 136 that includes a threaded portion that is configured to mate with a threaded portion of the container body 104 (not shown) so as to removably couple the housing 112, and more generally the lid assembly 108, to the container body 104. Of course, other connections such as snap-fit connections may be used to secure the housing 112, and more generally the lid assembly 108, to the container body 104.

With continued reference to FIGS. 3 and 4, the housing 112 also includes a flow opening 140 and a vent opening 142 each formed in the base 124. In this example, the flow opening 140 is defined by an annular wall 144 of the base 124 that is spaced radially inward of the circumferential wall 128. As illustrated, the annular wall 144 has a threaded inner surface 148 that is configured to mate with a threaded portion of the spout 120 so as to couple the spout 120 to the lid housing 112 and, more generally, the lid assembly 108. In the illustrated example, the base 124 has a flanged portion 150 that extends radially inwardly from the annular wall 144 so as to help properly align the spout 120 relative to the lid housing 112. In this example, the vent opening 142 is defined between a pair of surfaces 151 of the base 124 that extend inwardly from the circumferential wall 128 and the annular wall 144, respectively. In other examples, the flow opening 140 and/or the vent opening 142 can be defined by differently sized and/or shaped features of the base 124. In any event, when the lid assembly 108 is coupled to the container body 104, the flow opening 140 and the vent opening 142 are both in fluid communication with the interior of the container body 104.

Referring to FIGS. 1-4, the handle 116 in this example includes a base portion 152 and a gripping portion 156 that extends outward from the base portion 152 to allow the user of the container 100 to easily carry or transport the beverage container 100. The base portion 152 is defined by a substantially annular wall 160 and is directly coupled to a top portion of the lid housing 112. The gripping portion 156 includes a pair of opposing end walls 162 and a pair of opposing side walls 164 arranged therebetween. As illustrated, one of the end walls 162 and the side walls 164 together extend outward from the base portion 152 at an angle between approximately 5 degrees and approximately 90 degrees, and preferably between approximately 5 degrees and approximately 15 degrees. In this example, the gripping portion 156 also includes a carabiner-type element 168 that is arranged between one of the end walls 162 and one of the side walls 164 so as to allow the handle 116 (and more generally the beverage container 100) to be releasably coupled to another object such as a backpack strap or allow another object such as a key ring to be releasably coupled to the handle 116. In other examples, the gripping portion 156 need not include the carabiner-type element 168. In one such example, the gripping portion 156 can instead be an integral or unitary gripping portion formed from the end walls 162 and the side walls 164. In another such example, the gripping portion 156 can include a space between two of the various walls 162, 164 and/or can include a slot formed in one or more of the walls 162, 164 (so as to allow the handle 116 to be releasably coupled to another object such as a clip).

Turning specifically to FIGS. 3 and 4 again, the spout 120 in this example is made of silicone rubber and includes a dispensing portion 172, a mounting portion 176, and an intermediate portion 180 arranged between the dispensing and mounting portions 172, 176. In other examples, the spout 120, or portions thereof, can be made of another elastomer or other suitable material. The dispensing portion 172 defines a first or dispensing end 184 of the spout 120. The mounting portion 176 defines a second or mounting end 188 of the spout 120, opposite the first end 184, that is sized to be disposed in an upper portion of the flow opening 140 by and between the annular wall 144 and the flanged portion 150 of the lid housing 112. As illustrated, the mounting portion 176 is threaded to mate with the threaded inner surface 148 of the inner wall 144 so as to securely retain the mounting portion 176 in this position. The spout 120 also includes a fluid passageway 192 that is defined by and extends through the dispensing, mounting, and intermediate portions 172, 176, 180.

With reference to FIGS. 1-4, the spout collar 122 in this example includes a cover portion 196 and a catch portion 200 connected (e.g., snapped) to the cover portion 196. The cover portion 196 is disposed on a first or top side of the spout 120 along the dispensing portion 172 and the intermediate portion 180 of the spout 120. The catch portion 200 is disposed on a second or bottom side of the spout 120, opposite the top side, along the dispensing portion 172 and the intermediate portion 180 of the spout 120. The catch portion 200 defines an opening 212 that can be selectively engaged by a portion of the actuator assembly 123 to move the spout 120 between the dispensing and stowed configurations, as will be described in greater detail below. The actuator assembly 123 includes an actuator button 216 and a securing element 220 operatively coupled to the actuator button 216. The actuator button 216 is disposed on an exterior of the beverage container 100, and, more specifically, on the lid housing 112 proximate the base portion 152 of the handle 116. As illustrated in FIG. 4, the securing element 220 is arranged within the lid housing 112 to selectively engage the catch portion 200 of the spout collar 122 to retain the spout 120 in the stowed configuration. More particularly, the securing element 220, which in this example takes the form of a hook, is selectively disposed in the opening 212 of the catch portion 200, such that the spout 120 is securely retained in the stowed configuration.

As briefly discussed above, the spout 120 and the spout collar 122 are movable between the closed, stowed configuration of FIGS. 1 and 4, which corresponds to the open position of the container 100, and the open, dispensing configuration of FIGS. 2 and 3, which corresponds to the open position of the container 100, responsive to the manipulation (or lack thereof) of the actuator assembly 123. In this example, the spout 120 and the spout collar 122 are movable from the stowed configuration to the dispensing configuration when the user of the container 100 actuates the button 216, which drives the securing element 220 radially inward and out of the opening 212 of the catch portion 200, thereby releasing the securing element 220 from the catch portion 200. This allows the spout 120 to rotate in a first direction, indicated by arrow 224, toward the button 216 and away from the base 124. By virtue of the structure and resiliency of the spout 120, the spout 120 is biased to this position. Thus, to move the spout 120 and the spout collar 122 from the dispensing configuration to the stowed configuration, this bias must be overcome. In this example, this happens with the user of the container 100 releases the button 216, driving the securing element 220 radially outward, and manually rotates (or pushes) the spout 120 and the spout collar 122 in a second direction, indicated by arrow 228 and opposite the first direction, away from the button 216 and toward the base 124, until the catch portion 200 is aligned with, and the opening 212 of the catch portion 200 receives, the securing element 220. In other examples, however, the spout 120 and the spout collar 122 can be moved between these different configurations in a different manner. As an example, the button 216 may include an mechanical element that drives the spout 120 and the spout collar 122 from the dispensing configuration to the stowed configuration when the user releases the button 216, such that the mechanical element automatically moves, or at least assists the user in moving, the spout 120 and the spout collar 122 from the dispensing configuration to the stowed configuration. It will be appreciated that movement of the spout 120 between the stowed and dispensing configurations can, in some cases, be controlled just as is described in commonly owned U.S. application Ser. No. 14/046,400 and U.S. Pat. No. 8,602,238, the contents of which are hereby incorporated by reference in their entirety.

When the spout 120 is in the stowed configuration, the spout 120 is oriented at an angle that is close to, but not quite, perpendicular to a central longitudinal axis 232 of the beverage container 100, which in turn crimps the intermediate portion 180 of the spout 120, thereby crimping the passageway 192 and severing the fluid communication between the dispensing end 184 of the spout 120 and the interior of the container body 104, as is illustrated in FIG. 4. This, in turn, prevents the liquid contents of the container body 104 from being discharged from the container 100. When, however, the spout 120 is in the dispensing configuration, the spout 120 and the spout collar 122 are oriented in a direction that is close to, but not quite, parallel with the central longitudinal axis 232, such that the passageway 192 is intact, i.e., the dispensing end 184 of the spout 120 and the interior of the container body 104 are in fluid communication with one another, as is illustrated in FIG. 3. This, in turn, allows the user of the container 100 to consume (e.g., drink) the liquid stored in the interior of the container body 104 via the spout 120.

While not required, the lid assembly 108 in this example also includes a spout cover 250 that helps to keep the spout 120 clean when the spout 120 is in the stowed configuration (i.e., not in use). Like the spout 120, the spout cover 250 is movable between a stowed configuration, shown in FIGS. 1 and 4, and a dispensing configuration, shown in FIGS. 2 and 3. The spout cover 250 in this example includes a cover portion 254 and a flap 258 that is oriented at an angle that is close to, but not quite, perpendicular to the cover portion 254. When the spout 120 is in the stowed configuration, the spout cover 250 is also in the stowed configuration. When the spout cover 250 is in the stowed configuration, the dispensing end 184 of the spout 120 is arranged in an area defined between the cover portion 254 and the flap 258, with the cover portion 254 disposed over, or covering, the dispensing end 184 of the spout 120. The cover portion 254 thus prevents debris (e.g., dirt) from coming into contact with the dispensing end 184 of the spout 120. When the spout 120 is moved from the stowed configuration to the dispensing configuration, movement of the spout 120 in the first direction, indicated by the arrow 224, drives the cover portion 254 outward and upward (at least when viewed in FIG. 4), causing the spout cover 250 to rotate in a first direction, indicated by arrow 262, about an axis perpendicular to the central longitudinal axis 232, to the dispensing configuration. In the dispensing configuration, the spout cover 250 is spaced from the spout 120, such that the user of the container 100 can consume the liquid stored in the interior of the container body 104 via the spout 120. Like the spout 120, the spout cover 250 is also biased to the dispensing configuration, which is accomplished by way of a counterweight 270 connected to the cover portion 254 and the flap 258 in such a manner so that the center of gravity of the spout cover 250 is offset from (radially outward of) the axis about which the spout cover 250 pivots. Thus, to move the spout cover 250 from the stowed configuration to the dispensing configuration, this bias must be overcome. In this example, this happens when the spout 120 and the spout collar 122 are rotated in the second direction, indicated by the arrow 228. At some point during this process, the dispensing end of the spout 120 will be rotated into contact with the flap 258, which will in turn drive the flap 258 outward, causing the spout cover 250 to rotate in a second direction, indicated by arrow 266, about the pivot axis, until it reaches the stowed configuration. It will be appreciated that in this example, the spout 120 and the spout cover 250 move in opposite directions between the stowed and dispensing configurations.

With reference now to FIGS. 3-12, the lid assembly 108 also includes a sealing element 300 that allows or facilitates a controlled flow of the liquid contents from the interior of the beverage container 100 to and through the fluid passageway 192 of the spout 120. Typically, sealing element 300 is a one-way valve, for example, a duck bill valve, an umbrella valve, a cross-slit valve, or any other one-way valve suitable for performing the above-described functionality. This allows the user to drink the liquid contents from the spout 120 when negative pressure is applied (e.g., by the user) to the sealing element 300 via the spout 120 but prevents accidental spillage and leakage from the beverage container 100. As discussed above, known solutions for retaining sealing elements, such as the sealing element 300, in position include an interference fit and a straw having a component that utilizes a snap fit. The problem is that these known solutions are not particularly robust, such that the sealing element is susceptible to displacement when, for example, the beverage container is dropped or transported, or the lid is coupled to or decoupled from the container body. These known solutions also can negatively affect the cleanability of the beverage container by adding components that are themselves difficult to access (making them hard to clean) and/or serve to inhibit access to other components (e.g., the lid housing) of the beverage container (making those components hard to clean). Still further, these known solutions often include parts that are removably coupled to one another and thus include components that can be easily misplaced, for example, after cleaning.

The lid assembly 108, on the other hand, includes a seal mechanism 304 for retaining the sealing element 300 that is both robust and easily cleanable (either by hand or via the dishwasher). Generally speaking, the seal mechanism 304 is movable between an in-use position, shown in FIGS. 3-9, wherein the sealing element 300 is positioned within the lid housing 112 to permit fluid flow through the passageway 192 in a single direction when negative pressure is applied to the sealing element 300 via the spout 120, thereby allowing the user to drink but preventing accidental spillage or leakage, and a cleaning position, shown in FIGS. 11 and 12, wherein the sealing element 300 is spaced from and positioned outside of the lid housing 112 so as to facilitate easy access to the sealing element 300, and other components of the lid assembly 108, for cleaning purposes. When the seal mechanism 304 is in the cleaning position, and the sealing element 300 is spaced from and positioned outside of the lid housing 112, the sealing element 300 does not control fluid flow through the passageway 192.

The seal mechanism 304 in this example includes a seal housing 308 for holding or carrying the sealing element 300, a support base 312 coupled (e.g., secured) to the lid housing 112, a support arm 316 connecting the seal housing 308 and the support base 312, and a vent valve 320 coupled to the lid housing 112 (and more particularly the vent opening 142) via a retainer 321.

Figure 8:
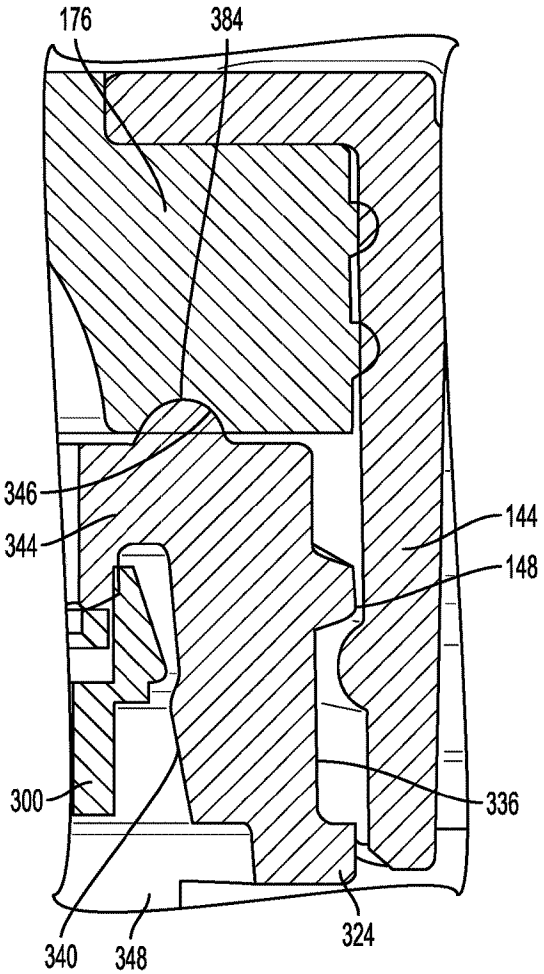
FIG. 8 is a close-up, cross-sectional view of a portion of the lid assembly of FIG. 3, showing a seal housing of the seal mechanism sealingly engaging a lid housing of the lid assembly.

The seal housing 308 in the illustrated example has a first annular portion 324, a second annular portion 328, and a neck 332 that connects the first and second annular portions 324, 328. As best illustrated in FIG. 8, the first annular portion 324 has an outer or exterior surface 336 that is threaded around its entire circumference, an inner surface 340, a rib 344 that extends inward from the inner surface 340, and a protuberance 346 that has a semi-circular shape in cross-section and extends outward (upward, when viewed in FIG. 8) from the first annular portion 324 between the outer surface 336 and the rib 344. The inner surface 340 and the rib 344 together define a channel sized to receive and securely retain the sealing element 300 in a manner that ensures that the sealing element 300 is properly radially aligned with the passageway 192 when the seal mechanism 304 is in the in-use position. The sealing element 300 is supported in the first annular portion 324 in this position by a horizontal shelf 348 that separates the first annular portion 324 and the neck 332. As best illustrated in FIG. 3, the neck 332 is defined by a cylindrical wall that features one or more windows 350 and has a diameter that is slightly smaller than the diameter of the first annular portion 324. As also illustrated in FIG. 3, the second annular portion 328 has a diameter that is larger than the diameter of both the first annular portion 324 and the neck 332. A shoulder 352 is defined between the second annular portion 328 and the neck 332.

Figure 5:
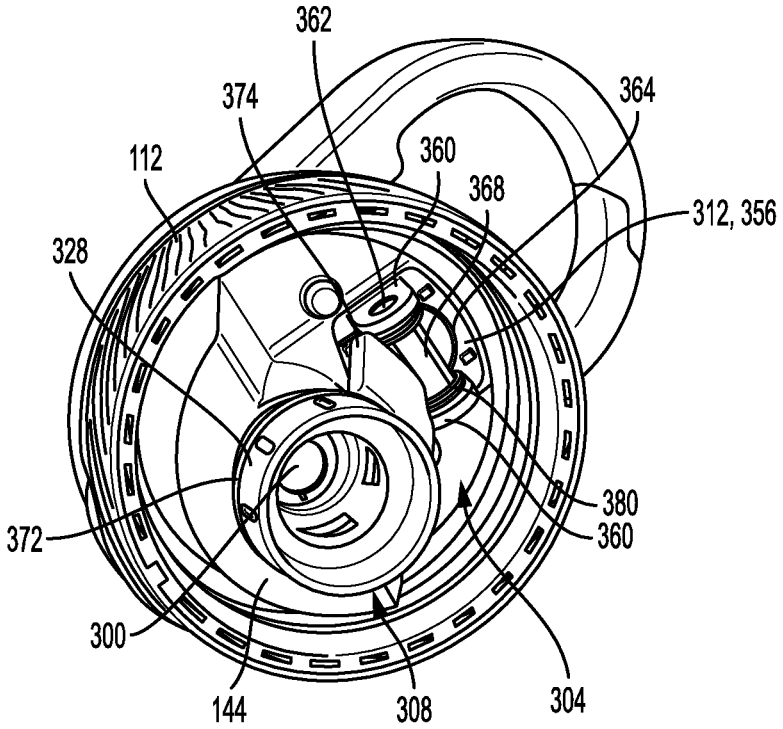
FIG. 5 is a first perspective view of an underside of the lid assembly of FIG. 3.
Figure 6:
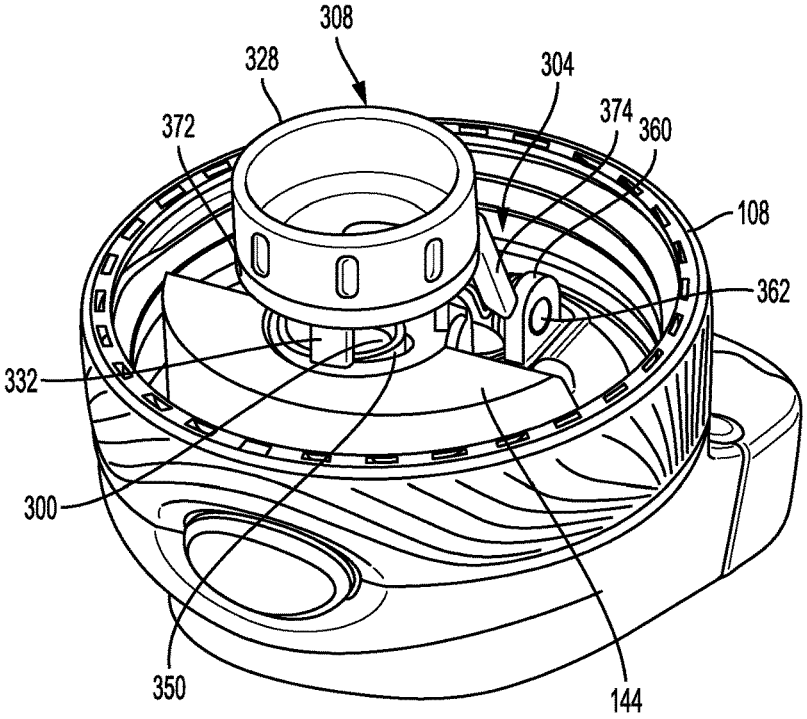
FIG. 6 is a second perspective view of the underside of the lid assembly of FIG. 3.
Figure 7:
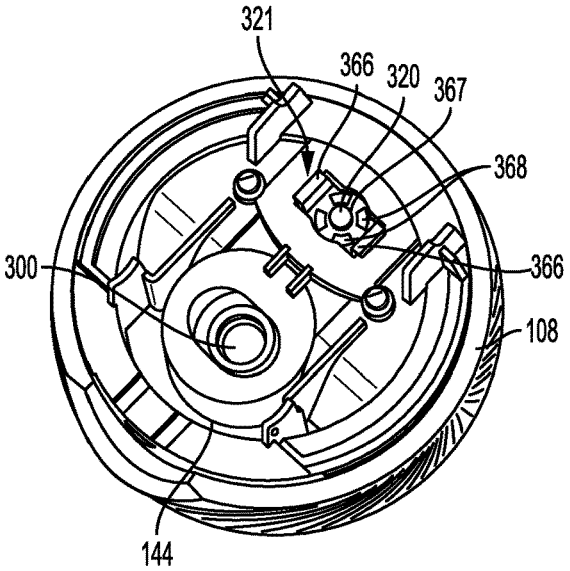
FIG. 7 is a bottom view of the lid assembly of FIG. 3, with portions of the seal mechanism removed.
Figure 9:
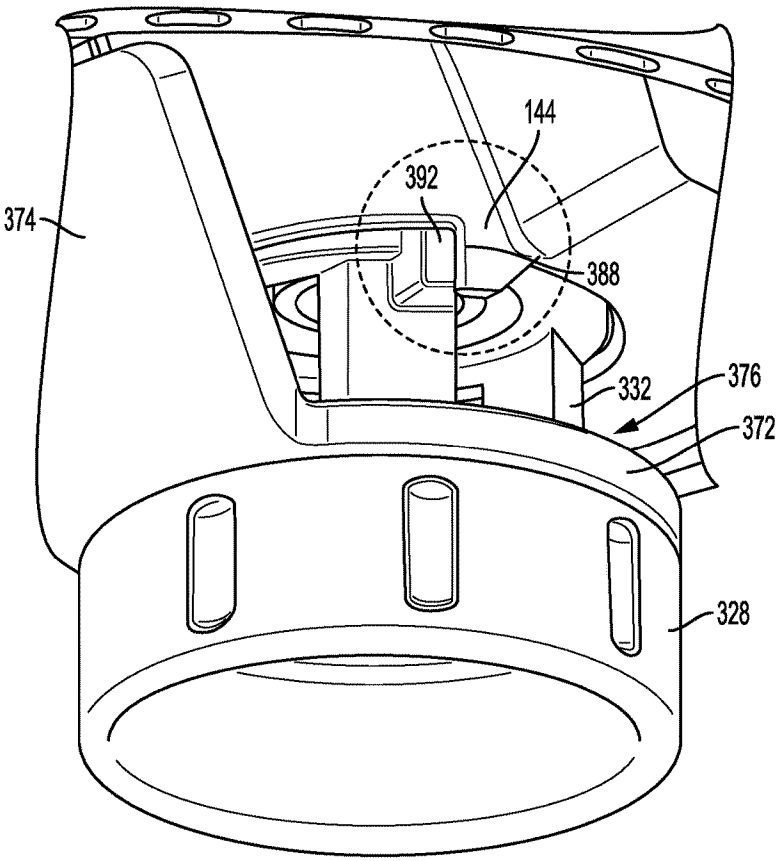
FIG. 9 is a perspective view showing the seal housing of the seal mechanism threadingly engaged with the lid housing of the lid assembly.

While somewhat difficult to see but best seen in FIGS. 5 and 6, the support base 312 in this example includes a support surface 356 and a pair of protrusions 360 that extend outward from the support surface 356. The support surface 356 defines a centrally located opening 364 (see FIG. 5) that is sized and shaped to match (or at least approximately correspond to) the vent opening 142. Each of the protrusions 360 includes a circular aperture 362 sized to receive a portion of the support arm 316, as will be described in greater detail below. As best illustrated in FIG. 7, the retainer 321 for the vent valve 320 has a pair of arms 366. The retainer 321 also includes a centrally located opening 367 that, like the opening 364, is sized and shaped to match the vent opening 142, as well as a plurality of vent openings 368 circumferentially arranged around the opening 364.

As best illustrated in FIGS. 3-6, the support base 312 is coupled to the vent opening 142 such that the support surface 356 is seated on or against the base 124 of the lid housing 112 and the opening 364 is substantially aligned with the vent opening 142. As best illustrated in FIG. 7, the retainer 321 is coupled to (e.g., disposed) in the vent opening 142 such that the arms 366 are seated on the base 124 of the lid housing 112 (to couple the retainer 321 to the lid housing 112) and the opening 367 is substantially aligned with the vent opening 142. The vent valve 320 in this example takes the form of an umbrella valve (but may be a different type of valve) and is disposed in the opening 367 and the vent openings 368, as illustrated in FIG. 7. The vent valve 320 prevents liquid from being discharged from the container 100 through the vent opening 142, but, at the same time, facilitates venting of the interior of the container 100 to the ambient environment external to the container 100.

The support arm 316 in this example includes, in relevant part, a shaft 368 and a retaining ring 372 connected to the shaft 368 via an L-shaped structure 374. While difficult to see but best seen in FIGS. 5 and 6, the shaft 368 has an interior portion having a first diameter, and two end portions that have a second diameter that is less than the first diameter, such that a shoulder is defined between the interior portion and each of the end portions. As illustrated, the end portions of the shaft 368 are rotatably arranged in the apertures 362 of the protrusions 360, respectively, with the interior portion and the shoulders of the shaft 368 arranged between the two protrusions 360. The retaining ring 372 defines an opening 376 that is sized to receive the neck 332 of the housing 308. More particularly, the opening 376 has an inner diameter that is larger than the diameter of the neck 332 but smaller than the diameter of the first and second annular portions 324, 328. The retaining ring 372 is thus movable along the neck 332 between the first and second annular portions 324, 328 as the seal mechanism 304 is moved between the in-use and cleaning positions, as will be described in greater detail below.

The seal mechanism 304 also includes a biasing element 380 that is arranged to bias the seal mechanism 304 to the cleaning position. In this example, the biasing element 380 takes the form of a torsion spring having one end coupled to a portion of the support base 312 and another end secured around the shoulders of the shaft 368. In other examples, the biasing element 380 can be a different type of spring and/or can be arranged differently.

Figure 10:
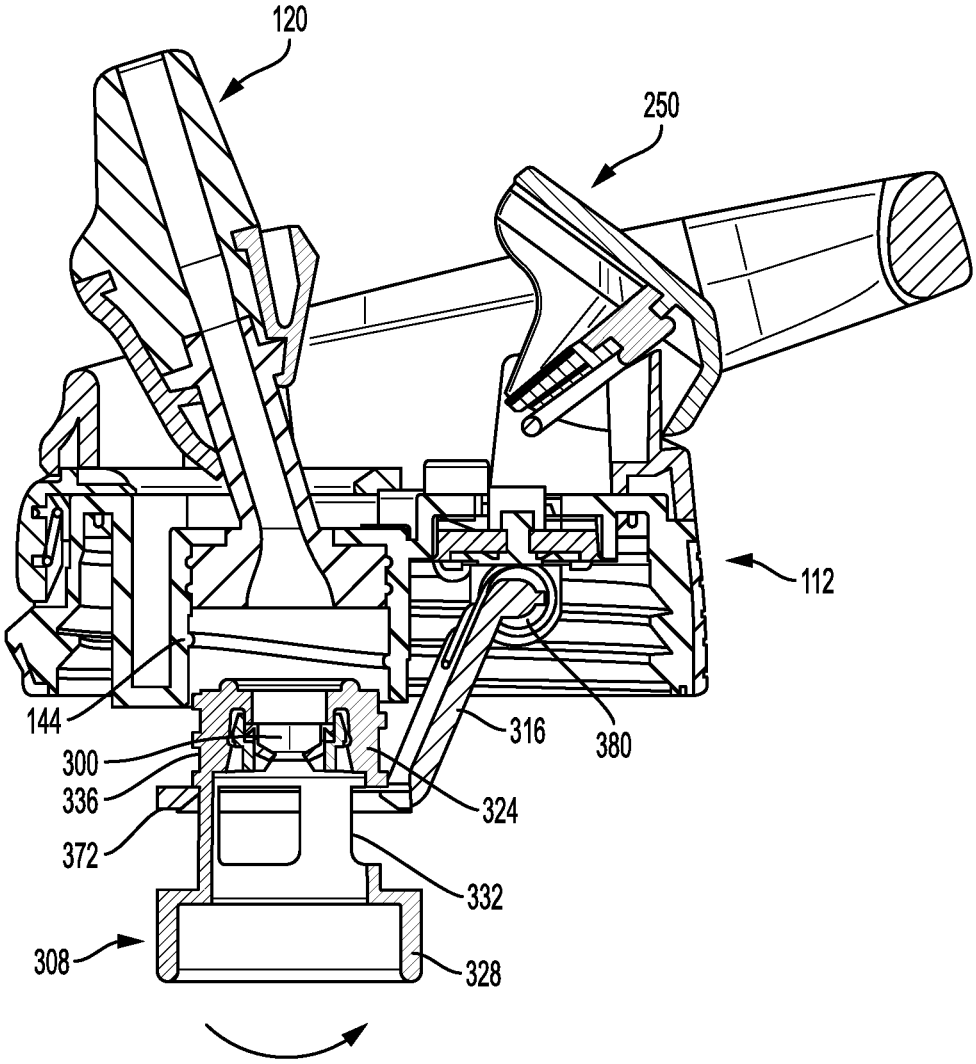
FIG. 10 is a cross-sectional view of the lid assembly, but showing the seal mechanism in a transitional position between the in-use position and a cleaning position.
Figure 11:
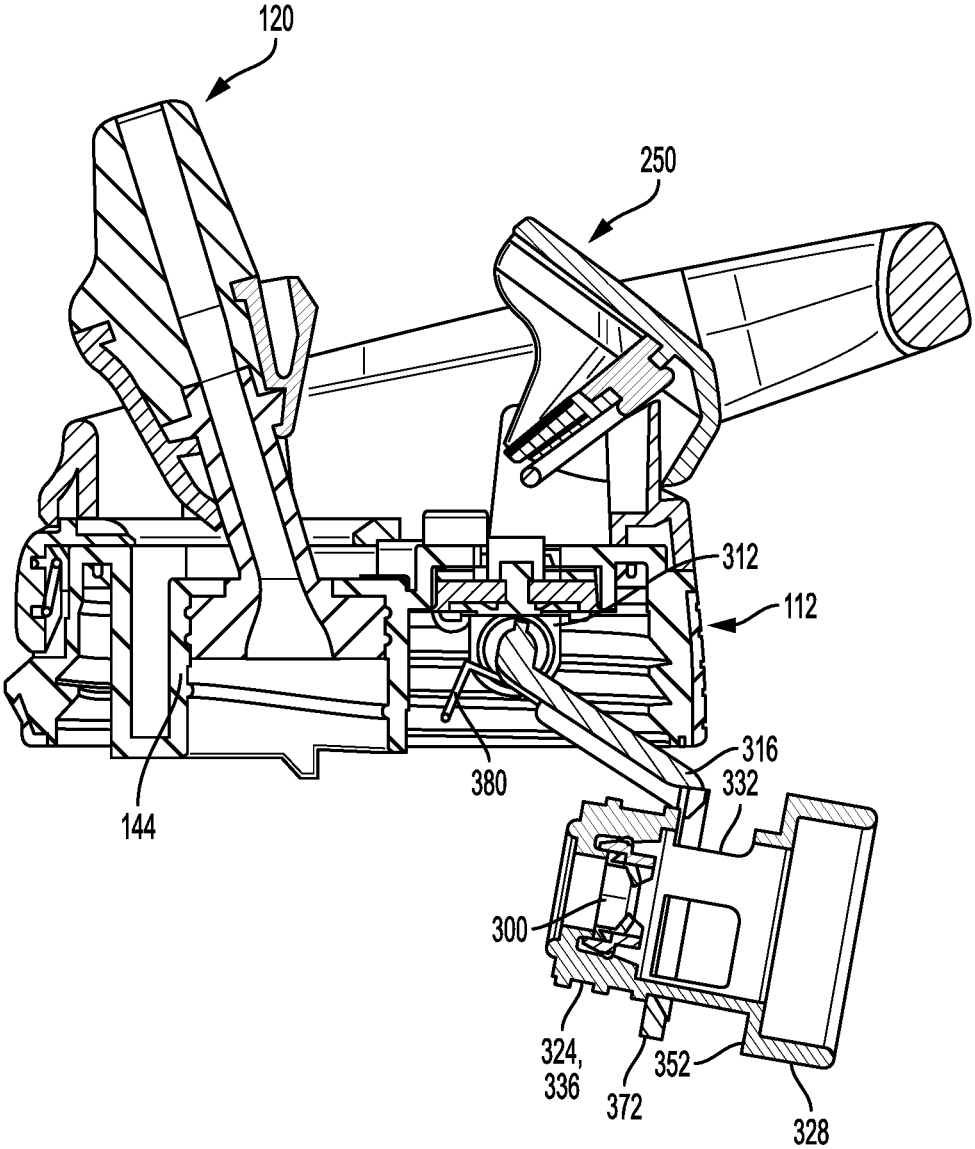
FIG. 11 is a cross-sectional view of the lid assembly, but showing the seal mechanism in the cleaning position.
Figure 12:
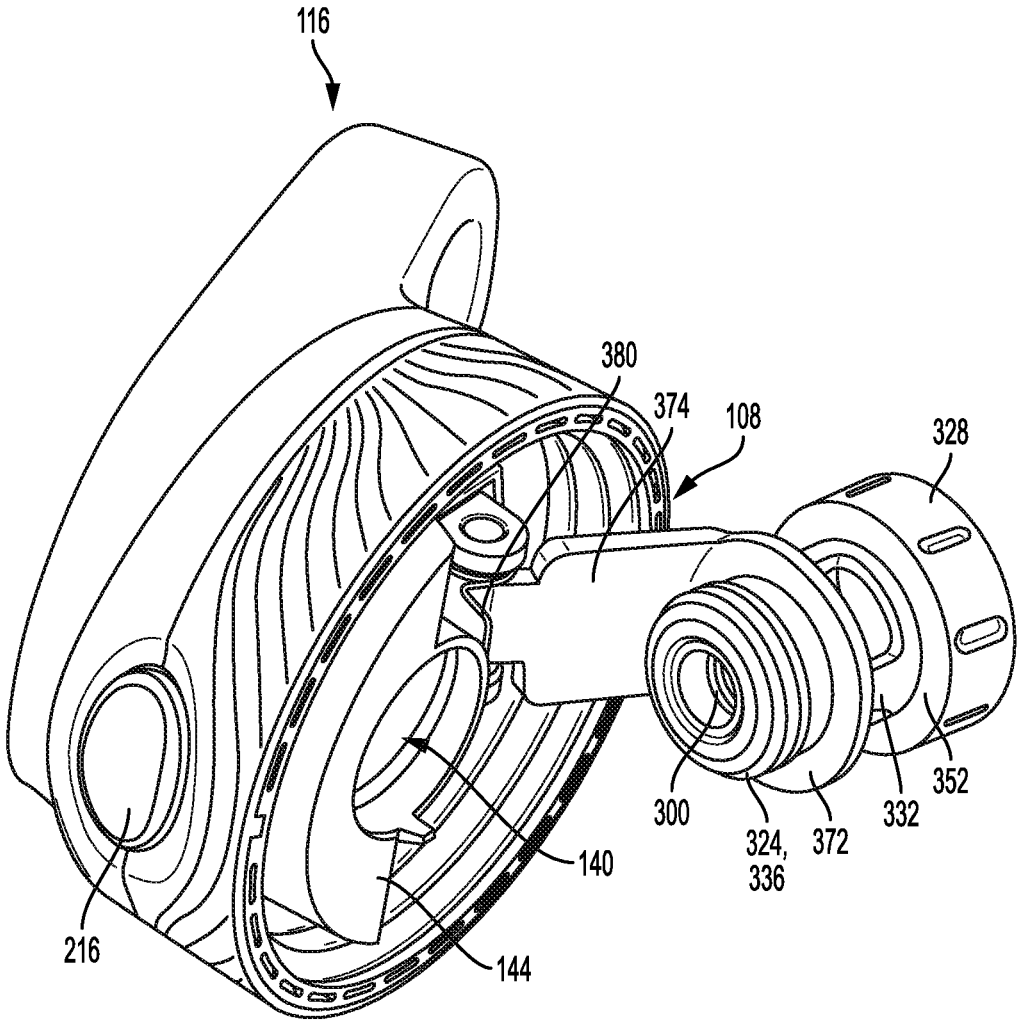
FIG. 12 is a perspective view of an underside of the lid assembly of FIG. 11.

As briefly discussed above, the seal mechanism 304 is movable between the in-use position shown in FIGS. 3-9 and the cleaning position shown in FIGS. 11 and 12 via the intermediate position shown in FIG. 10. When the seal mechanism 304 is in the in-use position, the first annular portion 324 of the housing 308 is arranged within the flow opening 140, inside of the annular wall 144, and the protuberance 346 of the seal housing 308 is sealingly arranged in a correspondingly shaped and sized opening 384 formed in the mounting portion 176 of the spout 120 (see FIG. 8), thereby effectuating a seal between the spout 120 and the first annular portion 324 of the housing 308. In this example, the first annular portion 324 is securely retained in the desired position via a threaded engagement between the threaded exterior surface 336 of the seal housing 308 and the threaded inner surface 148 of the annular wall 144. This threaded connection is strengthened by having the threaded exterior surface 336 and the threaded inner surface 148 overlap with one another (e.g., by approximately 4 mm), as best shown in FIG. 8. In this example, the annular wall 144 of the lid housing 112 includes a stop surface 388 that engages a stop 392 of the first annular portion 324 when the first annular portion 324 is threadably engaged in position, thereby providing the user of the container 100 with feedback that the seal mechanism 304 has reached and is secured in the in-use position. In other examples, however, the seal housing 308 can be securely retained in the in-use position using a snap-fit connection, a cam lock, or other suitable connection.

When the first annular portion 324 of the lid housing 308 is so arranged, the sealing element 300, which is carried by the seal housing 308, is positioned within the flow opening 140, immediately adjacent and radially aligned with the passageway 192. The sealing element 300 is thus positioned to control fluid flow through the passageway 192 in a manner that allows the user of the container 100 to consume the liquid stored in the container body 104 but prevents accidental spillage or leakage from the container 100 (caused by, for example, too much liquid flowing through the passageway 192). As illustrated in FIGS. 3-7 and 9, when the seal mechanism 304 is in the in-use position, the second annular portion 328 and the neck 332 are arranged outside of, but adjacent to, the flow opening 140, the retaining ring 372 is seated against the shoulder 352 defined between the second annular portion 328 and the neck 332, and the L-shaped portion 374 of the support arm 316 is oriented at an angle relative to the central longitudinal axis 232. As best illustrated in FIG. 6, because the second annular portion 328 and the neck 332 are arranged outside of the flow opening 140, and because the neck 332 includes the one or more windows 350, liquid flowing from the container body 104 and out of the container via the spout 120 is directed to and through the sealing element 300 via the windows 350. As also best illustrated in FIG. 6, the annular wall 144 of the lid housing 112 extends downward (when viewed in this FIG., at least) to a level that is approximately coincident with a point at which the first annular portion 324 transitions to the neck 332 (and vice versa); so arranged, the annular wall 144 helps to funnel liquid from container body 104, through the windows 350, and through the sealing element 300, thereby helping to prevent, or at least reduce, residual liquid build-up in the beverage container 100.

When it is desired to move the seal mechanism 304 from the in-use position to the cleaning position shown in FIGS. 11 and 12, the lid assembly 108 is removed from the container body 104, and the connection between the seal housing 308 and the lid housing 112 (as well as the spout 120) is released. In this example, this involves rotating the first annular portion 324 (particularly the threaded surface 336 of the first annular portion 324) out of threaded engagement with the annular wall 144 of the lid housing 112, which the user of the container 100 may accomplish by rotating the second annular portion 328 and/or the neck 332 of the housing 308, as depicted in FIG. 10. Once the connection between the seal housing 308 and the lid housing 112 has been released, the biasing element 380, which, as noted above, biases the seal mechanism 304 to the cleaning mechanism, drives (e.g., pulls, rotates) the support arm 316 to the position shown in FIGS. 11 and 12, which is oriented approximately 90 degrees relative to the position of the support arm 316 in the cleaning position. This, in turn, causes the retaining ring 372 of the support arm 312 to move from the shoulder 352 toward the first annular portion 324 and against the shoulder between the first annular portion 324 and the neck 332, and drives (e.g., pulls) the first annular portion 324 of the housing 308 completely out of and away from the flow opening 140. As a result, the seal mechanism 304, particularly the sealing element 300, is spaced from, or dropped down out of, the lid housing 112 and other components of the lid assembly 108. This facilitates easy and direct access to the sealing element 300 and easy access to other components of the lid assembly 108 for cleaning purposes.

Conversely, to move the seal mechanism 304 from the cleaning position to the in-use position, the seal housing 308 is connected (or re-connected, as the case may be) to the lid housing 112. In this example, this occurs when (i) the user of the container 100 rotates the seal housing 308 and the support arm 316 toward the flow opening 140 by applying a force to the housing 308 and/or the support arm 316 that exceeds a biasing force applied by the biasing element 380 (which biases the seal mechanism 304 to the cleaning position), and (ii) once the seal housing 308 and the support arm 316 are moved to the position shown in FIG. 10, the user rotates the first annular portion 324 (particularly the threaded surface 336) into threaded engagement with the annular wall 144 of the lid housing 112, as described above, which may be accomplished by rotating the first annular portion 324, the second annular portion 328, and/or the neck 332.

Figure 13:
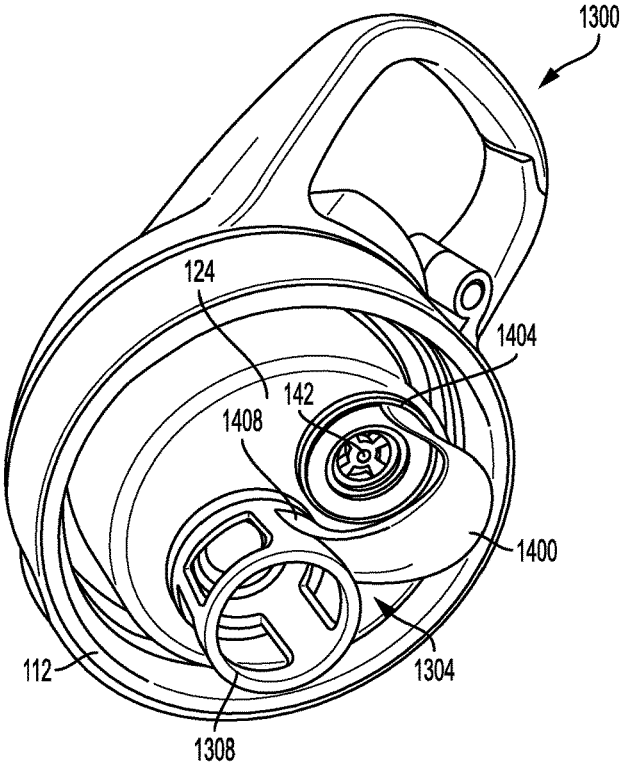
FIG. 13 is a perspective view of one example of a lid assembly constructed in accordance with the principles of the present disclosure, showing a portion of a seal mechanism of the lid assembly in an in-use position that allows the user to consume the liquid contents of the container but prevents accidental spillage or leakage from the container.
Figure 14:
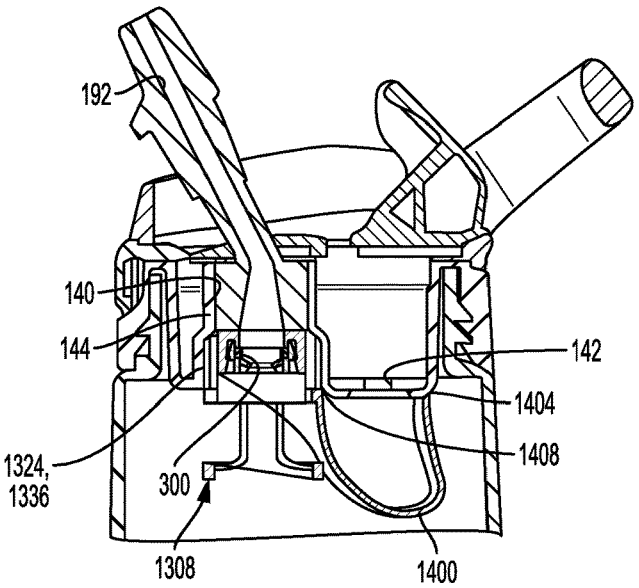
FIG. 14 is a cross-sectional view of the lid assembly of FIG. 13.

FIGS. 13 and 14 depict another example of a lid assembly 1300 that is constructed in accordance with the principles of the present disclosure and can be used with the portable and reusable beverage container 100 (or another beverage container). The lid assembly 1300 is substantially similar to the lid assembly 108 described above, with common components illustrated using common reference numerals. The lid assembly 1300 differs from the lid assembly 108 in that it includes a different seal mechanism, depicted as seal mechanism 1304, for carrying the sealing element 300. First, the seal mechanism 1304 includes a seal housing, seal housing 1308, that is structurally different from the seal housing 308 described above. Yet despite the visible structural differences between the seal housing 308 and the seal housing 1308, the seal housing 1308 similarly has a first annular portion 1324 that has an outer or exterior surface 1336 that is threaded around its entire circumference, such that the first annular portion 1324 can be threaded to the annular wall 144 in a similar manner as the first annular portion 324 to securely retain the first annular portion 1324, and the sealing element 300 carried by the first annular portion 1324, within the flow opening 140 when the seal mechanism 1304 is in the in-use position, shown in FIGS. 13 and 14. The seal mechanism 1304 also differs from the seal mechanism 304 in that it does not include the support base 312 or the support arm 316. Instead, the seal mechanism 1304 includes a tether 1400 that operatively connects the seal housing 1308 to the lid housing 112. As illustrated, the tether 1400 has a first end 1404 that is connected to the base 124 of the lid housing 112, and a second end 1408 that is connected to the seal housing 1308 at a position proximate the sealing element 300. The first end 1404 is shown as being connected to the base 124 immediately adjacent the vent opening 142, but in other examples, the first end 1404 can be connected to another portion of the lid housing 112. The second end 1408 is shown as being connected to the first annular portion 1324 of the seal housing 1308, but in other examples, can likewise be connected to other portions of the seal housing 1308. In any event, the tether 1400 allows the user to move the seal mechanism 1304 between the in-use position, wherein the sealing element 300 is securely retained within the lid housing 112 to control fluid flow through the passageway 192, and a cleaning position, not shown, wherein the sealing element 300 is positioned away from and outside of the lid housing 112 so as to facilitate easy access to the sealing element 300, and other components of the lid assembly 108, for cleaning purposes.

The invention claimed is:

1. A lid assembly for use with a portable beverage container, comprising:

a lid housing;

a spout coupled to the lid housing and movable between a stowed configuration and a dispensing configuration, the spout defining a fluid passageway;

a seal housing carrying a sealing element, the seal housing is movable between an in-use position, wherein the seal housing is coupled to the lid housing and engages the spout such that the sealing element controls fluid flow through the fluid passageway of the spout, and a cleaning position, wherein the seal housing is coupled to the lid housing and spaced from the spout to permit cleaning of the sealing element;

a support base coupled to the lid housing and the seal housing;

a biasing element coupled to a portion of the support base, the biasing element configured to bias the seal housing to the cleaning position; and a support arm connecting the seal housing and the support base, the biasing element coupled to a portion of the support arm.

2. The lid assembly of claim 1, wherein the sealing element comprises a one-way valve, and wherein when the seal housing is in the in-use position, the one-way valve facilitates a controlled fluid flow through the fluid passageway of the spout.

3. The lid assembly of claim 1, wherein the lid housing comprises an annular wall defining a flow opening in fluid communication with the fluid passageway, the spout having a dispensing end and a mounting end opposite the dispensing end, the mounting end arranged in the flow opening, and the seal housing having a portion removably arranged in the flow opening when the seal housing is in the in-use position.

4. The lid assembly of claim 3, wherein the portion of the seal housing is in threaded engagement with the annular wall of the lid housing.

5. The lid assembly of claim 1, further comprising an arm connecting the seal housing to the lid housing.

6. The lid assembly of claim 5, wherein the arm comprises a retaining ring that moves on the seal housing as the seal housing moves between the in-use position and the cleaning position.

7. The lid assembly of claim 1, wherein the seal housing is rotatable between the in-use position and the cleaning position.

8. A portable beverage container, comprising a container body defining an interior adapted to store a liquid; and a lid assembly, comprising:

a lid housing removably coupled to the container body;

a spout coupled to the lid housing and movable between a stowed configuration and a dispensing configuration, the spout defining a fluid passageway in selective fluid communication with the interior of the container body;

a seal housing carrying a sealing element, the seal movable between an in-use position, wherein the seal housing is coupled to the lid housing and engages the spout such that the sealing element controls fluid flow through the fluid passageway of the spout, and a cleaning position, wherein the seal housing is coupled to the lid housing and spaced from the spout to permit cleaning of the sealing element;

a support base coupled to the lid housing and the seal housing;

a biasing element coupled to a portion of the support base, the biasing element configured to bias the seal housing to the cleaning position; and a support arm connecting the seal housing and the support base, the biasing element coupled to a portion of the support arm.

9. The portable beverage container of claim 8, wherein the sealing element comprises a one-way valve, and wherein when the seal housing is in the in-use position, the one-way valve facilitates a controlled fluid flow from the interior of the container body through the fluid passageway of the spout.

10. The portable beverage container of claim 8, wherein the lid assembly does not include a straw fluidly coupling the interior of the container body with the fluid passageway of the spout.

11. The portable beverage container of claim 8, wherein the lid housing comprises an annular wall defining a flow opening, the spout having a dispensing end and a mounting end opposite the dispensing end, the mounting end arranged in the flow opening, and the seal housing having a portion removably arranged in the flow opening when the seal housing is in the in-use position.

12. The portable beverage container of claim 11, wherein the portion of the seal housing is threaded to the annular wall.

13. The portable beverage container of claim 8, further comprising an arm connecting the valve housing to the lid housing.

14. The portable beverage container of claim 13, wherein the arm comprises a retaining ring that moves on the seal housing as the seal housing moves between the in-use position and the cleaning position.

15. The portable beverage container of claim 8, wherein the seal housing is rotatable between the in-use position and the cleaning position.

16. The lid assembly of claim 1, wherein when the seal housing is in the in-use position, a portion of the seal housing is disposed outside of the lid housing.

* * * * *